US005345638A

United States Patent [19]

Nishida

[11] Patent Number: 5,345,638

[45] Date of Patent: Sep. 13, 1994

[54] PROCESS FOR PRODUCING A SHOE-SHAPED PART FROM A WEB OF MATERIAL AND RESULTING SHOE-SHAPED PART

[75] Inventor: Mamoru Nishida, Taichung, Taiwan

[73] Assignee: Tretorn AB, Helsingborg, Sweden

[21] Appl. No.: 80,071

[22] Filed: Jun. 23, 1993

Related U.S. Application Data

[63] Continuation of Ser. No. 899,690, Jun. 17, 1992, abandoned.

[30] Foreign Application Priority Data

Jun. 17, 1991 [JP] Japan ..... 4119911

[51] Int. Cl.[5] ..... A43D 8/00

[52] U.S. Cl. ..... 12/146 C; 36/45

[58] Field of Search ..... 36/45, 47, 48, 49; 12/142 G, 146 C

[56] References Cited

U.S. PATENT DOCUMENTS

| | | | |
|---|---|---|---|
| 217,467 | 7/1879 | Lee | 36/47 |
| 336,214 | 2/1886 | Cosart | 36/47 X |
| 336,913 | 3/1886 | Graff | 36/48 X |
| 505,298 | 9/1893 | Scarinci | 36/48 |
| 511,942 | 1/1894 | Glanville | 36/43 |
| 761,520 | 5/1904 | Matthew | 12/146 C |
| 1,021,819 | 4/1912 | Brihaye | 36/45 |
| 1,710,043 | 4/1929 | Campbell | 12/146 C X |
| 1,956,969 | 5/1934 | Ayers | 36/45 X |
| 2,001,962 | 5/1935 | Kantrow | 36/45 X |
| 2,076,285 | 4/1937 | Wiggin | 36/48 X |
| 2,300,155 | 10/1942 | Heintz | 36/45 X |
| 3,114,213 | 12/1963 | Bowers | 36/49 X |

FOREIGN PATENT DOCUMENTS

| | | | |
|---|---|---|---|
| 1674135 | 12/1953 | Fed. Rep. of Germany . | |
| 0021947 | 7/1900 | France | 36/47 |
| 627878 | 5/1930 | France . | |
| 858875 | 12/1940 | France . | |
| 862088 | 2/1941 | France . | |
| 1024102 | 3/1953 | France | 36/48 |
| 1028693 | 5/1953 | France | 36/48 |
| 537540 | 12/1955 | Italy | 36/48 |
| 6400090 | 7/1965 | Netherlands . | |
| 8400651 | 2/1984 | Netherlands . | |
| 0016092 | of 1894 | United Kingdom | 36/47 |
| 410311 | 5/1934 | United Kingdom . | |
| 1539886 | 2/1979 | United Kingdom | 36/49 |

*Primary Examiner*—Paul T. Sewell
*Assistant Examiner*—Ted Kavanaugh
*Attorney, Agent, or Firm*—Sixbey, Friedman, Leedom & Ferguson

[57] ABSTRACT

For the production of a shoe upper by cutting out of the shoe upper in the form of a layout from a web of material, shaping of the shoe upper with connection of material parts of the layout with formation of seams, a process is used by which such shoe uppers can be produced in a timesaving and efficient manner despite the many individual parts present or to be made visible. For this purpose, a web of material (1) is used to produce layouts (2) by different production measures, such as different styles, yarn material, color, material thickness, single layer or multilayer type of material or the like, at the same time with the production of web of material (1), and with a sole part attached to the layout. The layout is cut from the web as a unit with the sole part and processed into a shoe part having an upper and sole part.

20 Claims, 4 Drawing Sheets

2/4

PROCESS FOR PRODUCING A SHOE-SHAPED PART FROM A WEB OF MATERIAL AND RESULTING SHOE-SHAPED PART

This application is a continuation of Ser. No. 07/899,690, filed Jun. 17, 1993, now abandoned.

BACKGROUND OF THE INVENTION

This invention relates to a process for the production of a shoe shaped part using a web of material with a plurality of patterns in the form of the layout of a shoe upper, cutting out these layouts from the web of material and stitching the parts of the shoe upper to a top part, and fastening the related part of the sole to the edge area of the cut-open outside edge of the assigned layout and to a shoe shaped part produced according to this process.

A process according to this general type is known from German Patent No. 627 878. There, a web of material is produced so that it successively has three crosswise strips of different weaves. Patterns in the form of the U-shaped layout of a shoe upper are printed on these crosswise strips. The crosswise strips are produced so that the first strip is suitable for the counter-stiffener, the second strip for the vamp and the side portions, and the third strip for the toe cap. Consequently, the second crosswise strip is elastic and multilayered, and the two other crosswise strips are produced in a nonelastic, hard-wearing way. Stiffening threads can also be worked in, and the crosswise strip for the counter-stiffener can be produced as a tubular material into which a heel counter can be inserted. The U-shaped parts are cut out of the material, stitched on the open U-side, which forms the counter-stiffener, and then a sole applied in a way not described in detail.

SUMMARY OF THE INVENTION

In view of the above, the primary object of this invention is to further develop this previously known process so that a shoe upper, in many cases, can be configured together with the related sole part, for example, can be produced with strip-like markings, decorations or the like, and so that, in this case, the production of such a shoe upper is nevertheless possible in an efficient and economical way.

This object is achieved by the following process steps:

in the production of a web of material, both the patterns or partial patterns in the form of layouts of the shoe upper and the patterns or partial patterns in the form of a sole part, are produced by a fabric printing process (which is generally well known in the textile industry) on the web of material and/or by a textile production process inside the web of material;

to each layout of the shoe upper there is directly assigned a sole part and is attached to the layout in the correct position of the shoe upper;

in the production of the web of material, the layouts or the areas in which the layouts are provided are produced in a woven and/or knitted type different from the sole parts or those areas in which these patterns are provided;

those areas of the layouts and/or sole pans, which are exposed to the different stresses when wearing the shoe, are produced in the woven and/or knitted types correspondingly matched to the stresses they will experience;

the layouts and the sole parts assigned to one another are not completely separated from one another when cut out of the web of material, and remain connected with one another, as a cut-out unit, by corresponding material sections;

from the cut-out units, each of which has a layout with an associated sole part, first the layout is connected on the provided seams to a shoe upper, and then, the sole part is stitched or basted to the free outside edge of the corresponding layout.

By the process according to the invention, only just those parts of the web of material are produced in the necessary quality, thickness, multilayers or the like which correspond to the pattern or to an area of a pattern of the shoe upper or the related sole part. The remaining area of the web of material in contrast can consist of a simple, lightweight or inexpensive material quality, which holds together only the patterns or areas of such patterns in the web of material after their completion. The cutting waste accumulating with cutting out therefore represents a simple, lightweight and inexpensive material. In contrast, with the known material that has crosswise strips, the entire cutting waste, for example, consists of an expensive tubular material, multilayer material or the like.

It is of further advantage in the process according to the present invention that the individual patterns or partial patterns already can be produced directly in the production of the web of material in the desired shoe size, by which the cutting waste can be still further limited, since the individual patterns or partial patterns in the provided size can directly adjoin one another. Nevertheless, it is possible to configure the individual patterns or partial patterns soft, stiff, elastic, colored differently or the like, corresponding to the later stressing or desired shaping. Only inside and/or outside stiffening elements, such as inside and/or outside toe caps, heel counters or the like have to be applied later on.

With the use of program-controlled web of material production devices, after a one-time creation of the program, the size of the layout corresponding to the shoe size, the woven or knitted type of individual areas or contours, the type of fiber or yarn and/or the color can be selected almost at will. Therefore, only a small number of individual parts have to be produced separately and applied to the upper later.

These and other objects, features and advantages of the invention will be apparent from the following detailed description when viewed in conjunction with the accompanying drawings which show, for purposes of illustration, only several embodiments in accordance with the present invention.

DETAILED DESCRIPTION OF THE PREFERRED EMBODIMENTS

Figure 1:
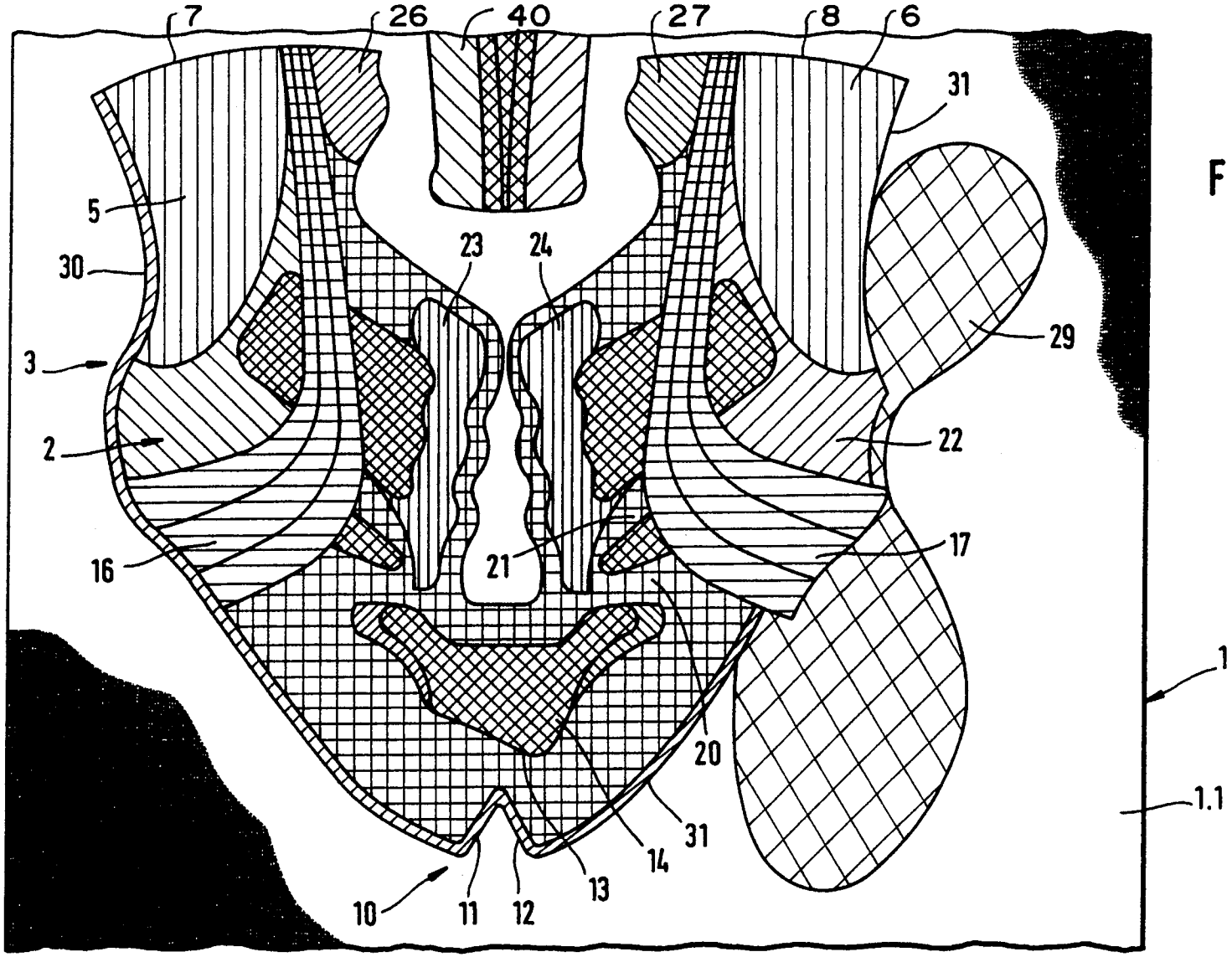
FIG. 1 is a top view of a section of a web of material with a layout for a shoe upper worked in during its production.
Figure 2:
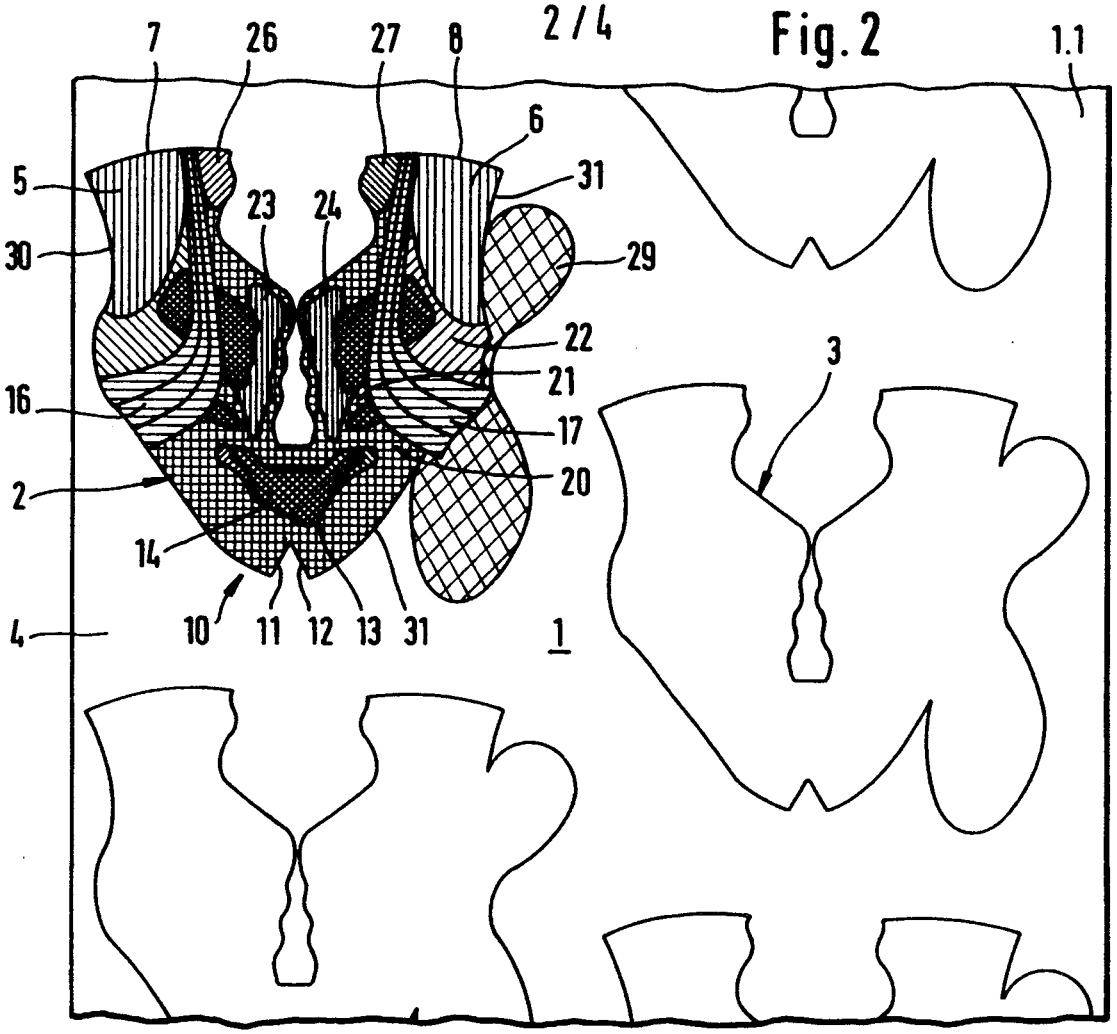
FIG. 2 is a section of a web of material with a plurality of layouts for different shoe uppers.

In FIGS. 1 and 2, a web of material is identified by 1, and is produced by a conventional textile process, tier example, by weaving and/or knitting and/or embroidering. The web of material 1 can be provided with a single or with a plurality of layouts 2 of the shape of a shoe upper 3, as it is represented from the side, for example, in FIG. 3.

The web of material has a backing 4 that can be a conventionally used material formed, for example, of a warp and filling or a knitted fabric. Layout 2 is divided into different individual parts or areas, which differ from one another, such as by being of another material style and/or by being of different fibers or yarns, for example, from wool, wool with metal yarns, silk, silk with metal yarns, wool with plastic fibers or the like and/or by being formed of different colors, such as from fibers or yarns of different colors, including those of metals, or by different color prints, and/or by being differently designed fiber extrudates or fiber extrudate compositions, such as twisted, processed parallel or the like.

Figure 3:
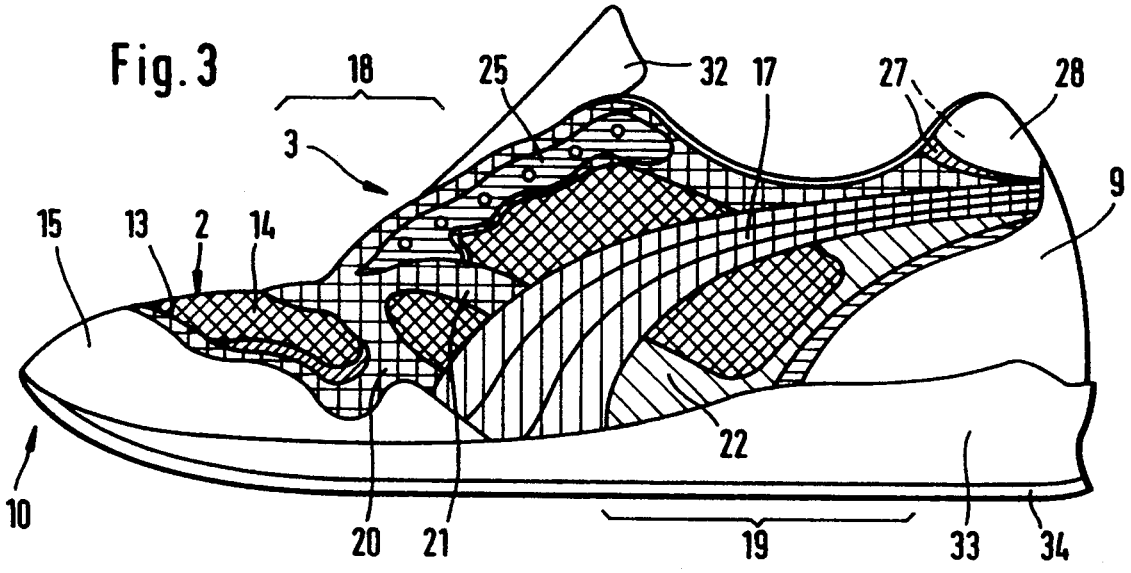
FIG. 3 is a side view of a shoe with an upper formed of a layout produced from a web of material according to FIGS. 1 and 2.

The individual parts or areas of shoe upper 3 can be representations of those areas on which a trimming, for example, a part resistant to wear, is applied. For example, areas 5 and 6 are provided for applying an inside or outside heel counter 9 (FIG. 3). After cutting out layout 2 from the web of material 1, the edges 7 and 8 are stitched together and a heel seam thus is formed. Then, heel counter 9, represented in FIG. 3, is applied, for example, glued and/or stitched, to adjacent areas 5 and 6.

Correspondingly, the contours of edges 11 and 12 are stitched together in the form of shoe toe 10, and a seam is formed on the shoe toe. To reduce wear, a toe cap 15, represented in FIG. 3, can be applied, especially glued and/or stitched, on the front area, adjacent to front edge 13 of toe area 14.

Since, generally, toe area 14 is designed to be relatively deformably soft or elastic, and optionally, also permeable to air, the web of material 1, in toe area 14, according to the present invention, is correspondingly designed by suitable selection of the weave pattern, knit pattern and/or the material used, such as, for example, Silk or plastic. The type of production can, additionally, insure that the toe area 14 has a good air exchange capability. For example, this can be achieved by a net-like woven or knitted structure.

The areas identified as positions 16 and 17 represent individual parts, which serve for identification purposes, such as the "Formstrip" trademark of PUMA AG Rudolf Dassler Sport illustrated in this case. Of course, other trademarks, identifications or patterning may be incorporated instead.

Areas 20, 21 and 22, identified in FIG. 3, running from instep area 18 to heel area 19, cannot only be configured in the form of pull straps but also can be produced especially tension-proof. In the production of web of material 1, suitable measures can be used to make these upper areas so as to achieve the desired effects; for example, in this case, especially tension-proof fibers or yarns can be used. Optionally, in this case, the material can be woven or knitted in two or more layers or can be especially thick or additionally embroidered. Similarly, the lacing areas 23 and 24 can be made dimensionally stable in corresponding manners, especially if, for example, no additional trimmings, such as the lacing strips 25, shown in FIG. 3, are to be applied.

Finally, in the embodiment according to FIGS. 1 and 2, with layout 2 on the web of material 1, areas 26 and 27 are produced in a configuration, color or style that is different from the other areas. A heel counter 28, represented in FIG. 3, is applied on areas 26, 27 after formation of the initially described heel seam.

As can be seen, any number of layouts 2 in the most varied configurations and/or designs as well as of different sizes can be produced on a single web of material 1. For this purpose, above all, the use of program-controlled, particularly computer-controlled, production devices is advantageous, so that style, color, design, size or the like can be varied at will.

According to an advantageous further development of the invention, an individual part 29 in the form of an insole can be co-produced on layout 2 of shoe upper 3. After being cut out, this individual part 29 remains connected with layout 2, and after or during the shaping and fixing of shoe upper 3 from layout 2, part 29 is folded into the plane of the shoe sole and is fastened to the lower edge zone of the shoe upper 3. This lower edge zone is defined in layout 2 by outside contours 30 and 31, and the manner of its fastening can be, in a way known in the art, for example, by gluing, stitching, tacking or the like.

In the production of web of material 1 or after its production, and optionally after cutting out of layout(s) 2, layout(s) 2 can be provided with an embroidery, especially with an English embroidery (i.e., the type of embroidery by which a hole pattern is welded and which is commonly used for the sewing of button holes), of a trademark or another mark or identification on suitable or preferred places.

Finally, before or after cutting out of layout(s) 2, a tongue 32 (FIG. 3) is applied in the forefoot area. After the production of shoe upper 3, an insole and/or a midsole, optionally, is additionally applied or molded on.

Completed shoe upper 3 is then brought into a gluing, injection or casting mold, in which a midsole 33 and an outsole 34 are molded by known measures, as is represented in FIG. 3.

The advantages of the previously described process according to the invention can be seen especially in the fact that, with a fully developed loom, up to 7 different textile fibers or yarns, and the same number of colors, can be put in, especially woven in, the web of material in one operation. As already indicated, any sizes and different upper designs can be produced by computer-controlled programs, starting from corresponding basic patterns. The completed shoe uppers produced from such webs of material are marked by an extremely low weight, for example, between 70 to 80 g in a shoe size of 8. The costs for the production of such uppers are exceptionally low in comparison with previously known processes.

In FIGS. 1 and 2, unfinished surface areas, which lie outside layouts 2 for shoe upper 3 or for tongue 40, are shown with position number 1.1.

According to an advantageous further development of the invention, the sole part 29, which is represented in FIGS. 1 and 2 as an individual part, can be designed so as to be divided lengthwise, crosswise or obliquely into at least two. In such a case, at least one sole part section is provided on each outside contour 30, 31 of a layout 2.

Figure 4:
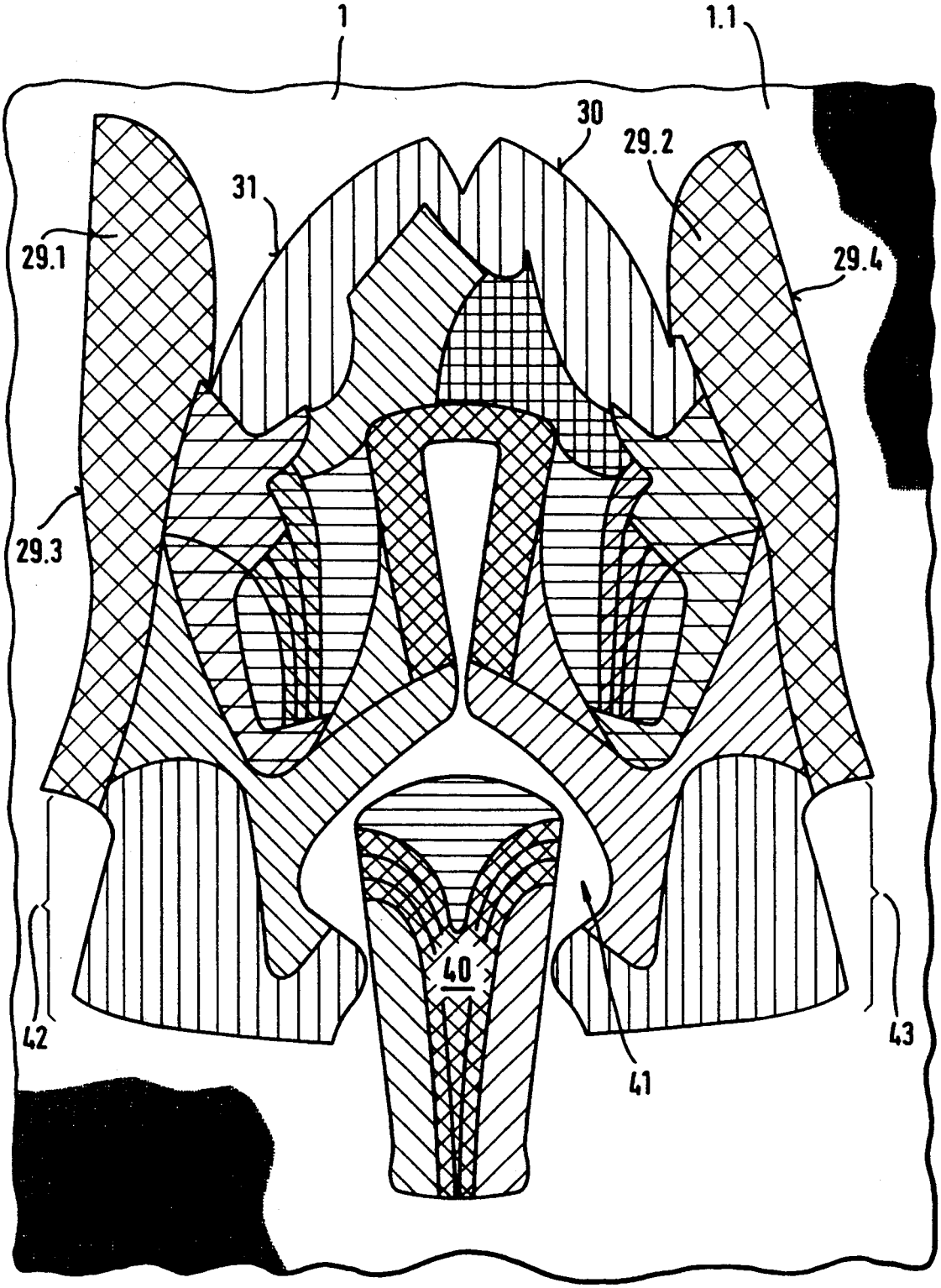
FIG. 4 shows a section of a web of material with a layout having sole part sections provided on both sides as well as a tongue.

With the embodiment according to FIG. 4, a sole part section 29.1 that extends over the entire length of the sole is provided on outside contour 31 in the approximate form of a half of sole part 29, and a sole part section 29.2 which forms the remainder of sole part 29 is provided on the outside contour 30. Both sole part sections 29.1 and 29.2 complement each other to complete sole part 29. In this case, their outside contours 29.3 and 29.4 are connected with one another, for example stitched and/or glued and/or fused or the like, preferably by a longitudinal seam.

Figure 5:
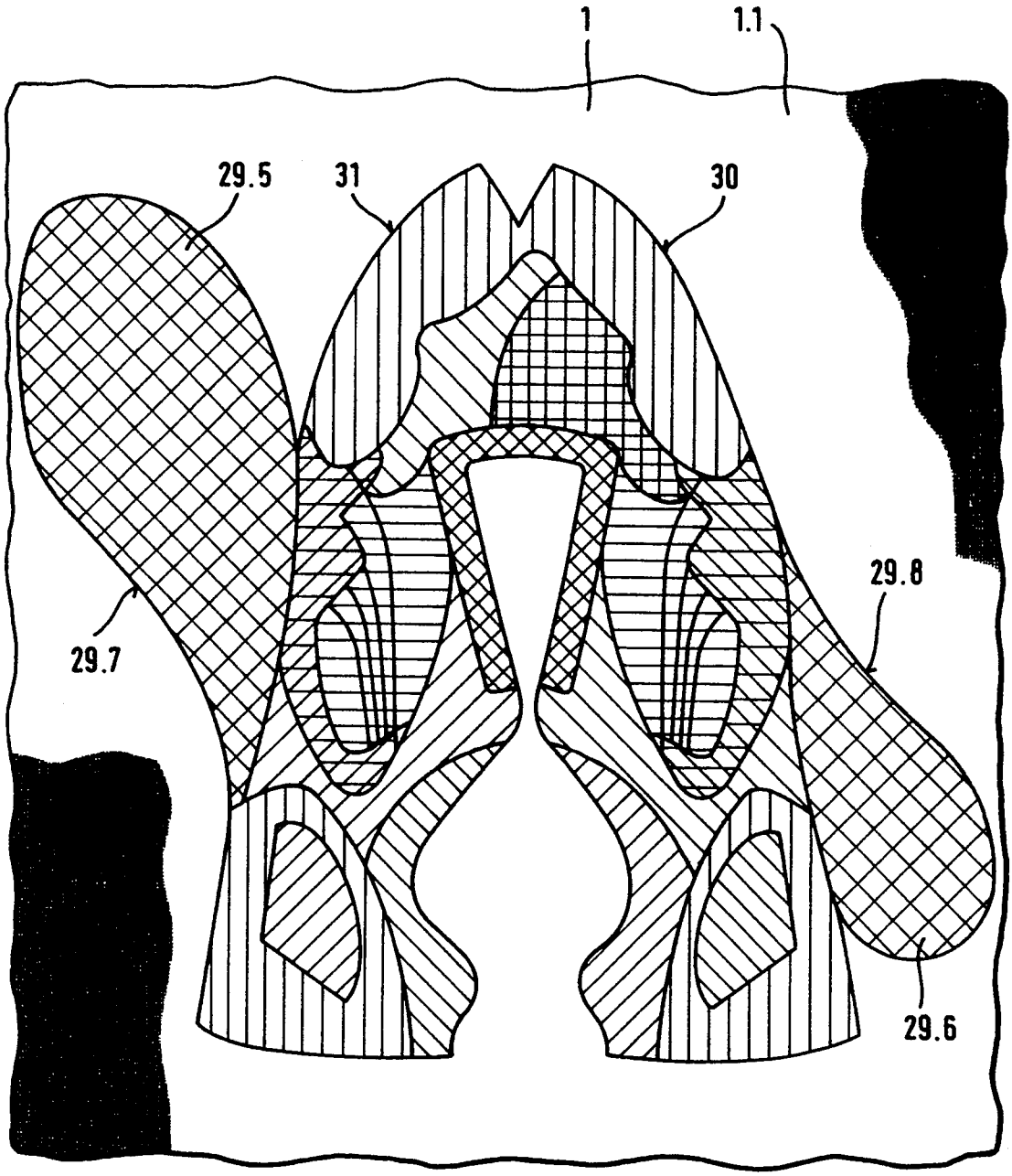
FIG. 5 shows a section of a web of material with a layout which has a forefoot sole part section on one side and a rear or heel part sole part section on the opposite side.

With the embodiment according to FIG. 5, a forefoot sole part section 29.5 is provided on outside contour 31 of layout 2 of shoe upper 3, and a heel sole part section 29.6 is provided on outside contour 30. Their outside contours 29.7 or 29.8 are later folded under so as to face the middle of shoe upper 2 and are connected with one another to, then, form the entire sole part 29. The seam resulting in this case runs crosswise, obliquely, or obliquely in approximately an S-shape or the like corresponding to the configuration of outside contours 29.7 or 29.8. The path of this seam is preferably selected so that it cannot exert an unpleasant pressure on the sole of the foot.

Additionally, the tongue 40, for example, according to FIG. 4, can be provided also in the course of producing the web of material 1 with different weave structures and/or weave patterns and/or embroideries or with one or with several prints or the like. On a web of material 1, different tongues 40 can be produced corresponding to a shoe shape and/or a shoe size both in shape, size, color or colors, patterns or the like. Preferably, in each case, related tongues 40 are produced simultaneously with a layout 2 on same web of material 1.

For optimum surface use of web of mmaterial 1, a tongue 40 can be produced in the open space 41 located between the two layout sections 42 and 43, which later form the rear of foot or heel-pan shoe part.

Preferably, each layout 2 has at least five, preferably more than ten, patterns and a tongue 40 has at least two, preferably at least three patterns produced or appearing, which are different from one another in each case.

In an advantageous further embodiment of the invention, the web of material 1 is produced so that its surface areas 1.1, in which no layout(s) 2 or tongue(s) 40 are provided, consist of a lightweight material quality that is as simple and economical as possible. For example, these surface areas 1.1 can be produced like a gauze or with low to very low warp and/or filling gauge and/or, for example, by being thin-spun or the like. Thus, an especially efficient production of shoe shaped parts, such as shoe uppers is assured in connection with soles and/or tongues or the like.

Preferably, areas of layout(s) 2, sole parts 29, especially of sole part sections 29.1 and 29.2 or 29.5 and 29.6, can comprise a textile portion of material which can soak up moisture well. Preferably, cotton is used for this purpose. The portion of the absorbent material is at least about 25% of the entire material. Depending on the application, this portion can be increased up to 100%.

As already indicated, the webs of material being used can be produced by program-controlled web material production devices whose programs can be matched almost at will according to the corresponding basic setting with deviations in the size of the layouts of the individual shoe uppers or with changes of the type of weave or knit of individual areas or contours, the type of fiber or yarn and/or the color.

I claim:

1. Process for the production of a plurality of shoe shaped parts using a web of material having a plurality of patterns in the form of a layout of a shoe upper thereon, comprising the following process steps:

producing a web of material having an overall construction and having at least portions of patterns thereon which are in the form of layouts of a shoe upper and a sole part, wherein in each layout the shoe upper is directly associated with a sole part by the sole part being attached to the layout in a position of the shoe upper corresponding to an intended location of the sole part relative to the shoe upper in a finished shoe, wherein the layouts of the shoe upper and sole parts are produced by modifying the overall construction of the web of material in the locations of the layouts relative to that in portions thereof where the layouts of the shoe upper and the sole parts are not provided, using one of a different weaving and knitting type for the layouts of the shoe upper than is used for producing the sole parts, said weaving and knitting types being matched to differing requirements for materials of the shoe upper and sole part of a shoe in relation to properties thereof including at least one of the properties of absorptivity, air permeability, softness, extensibility, wear resistance and appearance;

cutting out the layouts from the web of material in a manner leaving the layouts of the shoe upper at least partially connected to the sole parts directly associated therewith as a cut-out unit; and first stitching parts of the layout of the cut-out unit on provided seams to form an upper of the shoe shaped part, and then fastening the associated sole part of the cut-out unit to an outside edge area of the associated layout by one of stitching and basting.

2. Process according to claim 1, further comprising the step of providing at least one of the layouts of the shoe upper and the sole parts with stiffening means in areas thereof.

3. Process according to claim 1, wherein, during said producing step, the sole part is formed of sole part sections which extend over the entire length of an insole to be formed and which are connected to outside contours of the layout of the shoe upper; and wherein outside edge portions of the sole part sections are fastened together, by producing a lengthwise seam, to form the sole part

4. Process according to claim 1, wherein, during said producing step, the sole part is formed of forefoot sole part section on one outside contour of the layout of the shoe upper and of a heel sole part section on another outside contour; and wherein outside edge portions of the sole part sections are fastened together, by producing one of a crosswise, obliquely, and S-shaped seam, to form the sole part.

5. Process according to claim 1, comprising the further step of applying an embroidery at least to the layouts.

6. Process according to claim 5, wherein the embroidery is produced at least partially as English embroidery.

7. Process according to claim 1, further comprising the step of applying one of an insole and a midsole to the sole part after forming of the shoe upper.

8. Process according to claim 1, further comprising the step applying a tongue to the layout by at least one of stitching, gluing and lasting.

9. Process according to claim 8, wherein tongues are produced on a web of material of at least one of different patterns, different types of textiles, colors, and pressures.

10. Process according to claim 9, wherein said tongues are produced on the same web of material as the layouts and sole parts.

11. Process according to claim 10, wherein the tongues are made at least partially in an open space between sections of the layout which later are formed into a heel part of the shoe upper.

12. Process according to claim 10, wherein the tongues are produced on a portion of said web of material which is of at least one of a lower quality, density and weight relative to portions of the web of material on which the layouts are produced.

13. Shoe shaped part produced by the process of claim 10, wherein each layout is produced having at least five patterns of different types of production.

14. Shoe shaped part according to claim 13, wherein each tongue is produced having at least two patterns of different types of production.

15. Shoe shaped part according to claim 14, wherein the sole part has a textile portion made of a material with good moisture-absorbing properties.

16. Shoe shaped part according to claim 15, wherein the material with good moisture-absorbing properties is cotton.

17. Shoe shaped part according to claim 15, wherein the material with good moisture-absorbing properties comprises at least about 25% of the entire material of which the sole part is formed.

18. Shoe shaped part produced by the process of claim 10, wherein each layout is produced having at least five patterns of different types of production.

19. Shoe shaped part according to claim 18, wherein the sole part has a textile portion made of a material with good moisture-absorbing properties.

20. Process according to claim 9, wherein the tongues are produced on a web of material which is of at least one of a lower quality, density and weight relative to the web of material on which the layouts and sole parts are produced.

* * * * *

UNITED STATES PATENT AND TRADEMARK OFFICE

CERTIFICATE OF CORRECTION

PATENT NO. : 5,345,638

DATED : September 13, 1994

INVENTOR(S) : Mamoru Nishida

It is certified that error appears in the above-identified patent and that said Letters Patent is hereby corrected as shown below:

Title page, Item No. [30], change "Japan" to -- Germany --

Signed and Sealed this

Thirteenth Day of December, 1994

*Attest:*

*Attesting Officer*

BRUCE LEHMAN

*Commissioner of Patents and Trademarks*